United States Patent [19]

O'Connell

[11] Patent Number: 4,512,666

[45] Date of Patent: Apr. 23, 1985

[54] ADJUSTABLE HEIGHT MAGNETIC STIRRER

[75] Inventor: Dennis M. O'Connell, Corning, N.Y.

[73] Assignee: Corning Glass Works, Corning, N.Y.

[21] Appl. No.: 583,576

[22] Filed: Feb. 24, 1984

[51] Int. Cl.[3] ..... B01F 13/08

[52] U.S. Cl. ..... 366/249; 366/273; 366/286

[58] Field of Search ..... 366/242, 243, 244, 245, 366/247, 248, 249, 250, 251, 252, 253, 254, 273, 274, 279, 285, 286, 349

[56] References Cited

U.S. PATENT DOCUMENTS

| | | | |
|---|---|---|---|
| 3,209,387 | 10/1965 | Lukesch | 366/247 |
| 3,572,651 | 3/1971 | Harker | 366/273 |
| 3,622,129 | 11/1971 | Mazowski | 366/247 |
| 3,888,466 | 6/1975 | Sedam | 366/274 |
| 4,204,774 | 5/1980 | de Bruyne | 366/273 |
| 4,382,685 | 5/1983 | Pearson | 366/349 |

*Primary Examiner*—Robert W. Jenkins
*Assistant Examiner*—Arthur D. Dahlberg
*Attorney, Agent, or Firm*—B. D. Voyce

[57] ABSTRACT

The present invention relates to suspended magnetic stirrers. More particularly, it discloses a stirrer having a suspended magnetic impeller, the height of which is adjusted by a movable bearing. The invention is particularly useful in applications where solids must be suspended in a liquid medium with a minimum of shear force, such as in microcarrier tissue cell culture.

3 Claims, 3 Drawing Figures

ADJUSTABLE HEIGHT MAGNETIC STIRRER

TECHNICAL FIELD

The present invention relates to suspended magnetic stirrers. More particularly, it discloses a stirrer having a suspended magnetic impeller, the height of which is adjusted by a movable bearing. The invention is particularly useful in applications where solids must be suspended in a liquid medium with a minimum of shear force, such as in microcarrier tissue cell culture.

BACKGROUND ART

FIG. 1 of U.S. Pat. No. 3,622,129 to Edward Mazowski shows how the problem of adjusting impeller heights of sterile suspended stirrers has been tackled in the prior art. The shaft friction-fits into and through a hole in the vessel closure. One adjusts the impeller height by sliding the end of the shaft that extends outside the vessel.

While Mazowski is operative, it is not desirable. In sterile environments, contaminants can be introduced by sliding the shaft. Also, over time the friction fit will be reduced, increasing the chance of slippage. Finally, fine height adjustments can be difficult when one has to gauge what force is required to move the shaft a precise distance.

DISCLOSURE OF THE INVENTION

The present invention comprises an improved magnetic stirring apparatus capable of suspending solids in a liquid medium with a minimum of shear force. It has a novel adjustment means whereby the impeller can be precisely positioned, time after time.

The instant stirring device has conventional stirrer elements such as: a vessel for containing fluids and solids, having walls, a bottom, and an opening at the top; a stirrer having a shaft and a magnetic impeller, and a closure. However, the present invention has additional elements which, when combined with those above in a novel and non-obvious way, create an adjustable height stirring device which is particularly useful in sterile applications.

The present invention can be described as follows. The closure has an opening. Connected to the closure and completely about the opening is a hollow adjustment support member which projects upwardly therefrom. At least part of the length of the support interior is threaded.

A hollow sleeve elevation member is dimensioned and configured with corresponding threads such that it can be screwed into the support. A portion of the sleeve can extend beyond the top of the support, while the interior sleeve diameter or bore is sized so as to be able to receive the stirrer shaft.

The stirrer bearing is composed of an annular lower bearing surface and a rotating upper bearing surface. The lower surface is attached to the interior of the sleeve. The opening in the lower bearing surface is dimensioned and configured also to receive the shaft. The upper surface has a larger diameter than this opening and downwardly engages the lower bearing surface.

The stirrer is suspended by being connected to the upper bearing surface. It projects downwardly towards the vessel bottom through the lower bearing surface and the sleeve, into the vessel.

Finally, the adjustment means has an upper and lower portion. The upper portion is dimensioned and configured to engage a portion of the sleeve while permitting the upper bearing to rotate. Meanwhile, the lower portion is dimensioned and configured to slide over the exterior of the support. When the means is placed over the support and engages the sleeve, the impeller height can be adjusted simply by rotating the means. This motion is translated into movement of the sleeve, the bearing surfaces, and thus, the stirrer.

The above stirrer provides several advantages. First, the bearing of the suspended stirrer is out of the vessel where it could grind particles. Also, it offers precise adjustment as well as covering the elevated bearing. These qualities are particularly useful in microcarrier cell culture where sterility and an absence of abrasion are highly desirable.

BEST MODE OF CARRYING OUT THE INVENTION

Figure 1:
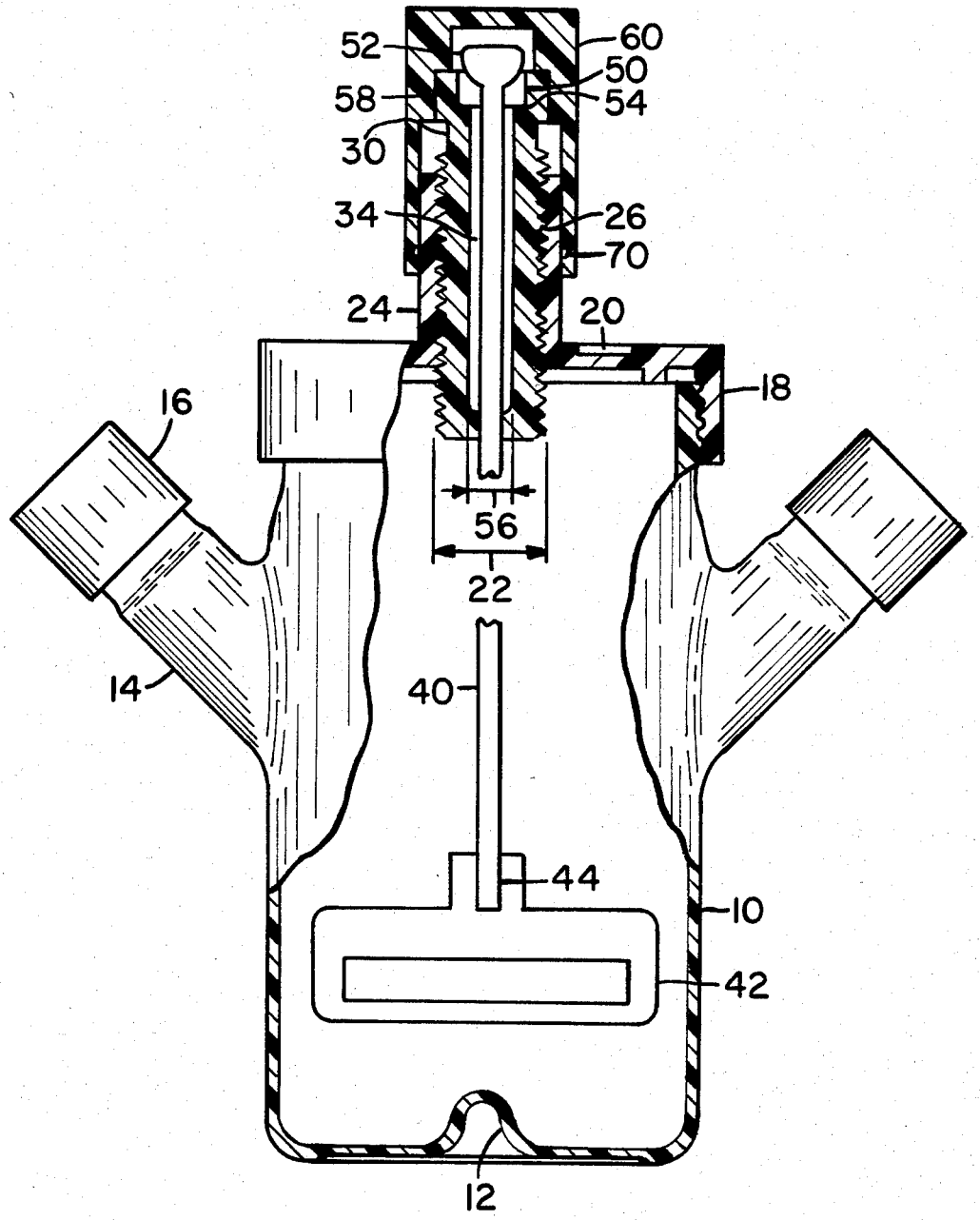
FIG. 1 is a cross-sectional view of the stirrer.

In a preferred embodiment (FIG. 1) for use in suspended microcarrier cell culture, the present invention has a vessel (10) having walls, a bottom and a threaded opening at the top. A projection (12) rises from the center of the bottom to a height of about a half inch. The corners are radiused where the walls meet the bottom. On opposite upper wall surfaces are side ports (14) covered with closures (16). These are designed to enable one to decant liquids from the vessel.

The opening is covered by a correspondingly threaded closure (18), a section of which has an oxygen and gas permeable, cell contaminant-impermeable membrane (20) made, for example, from polyethylene. After screwing the closure on, the membrane allows an exchange of respiratory gasses without fear of contamination.

The closure has an opening (22). Integral with the closure is a hollow adjustment support member (24) which projects upwardly therefrom and surrounds the opening. Alternatively, the support can be a separate piece. At least part of the length of the support bore is threaded (26).

Figure 2:
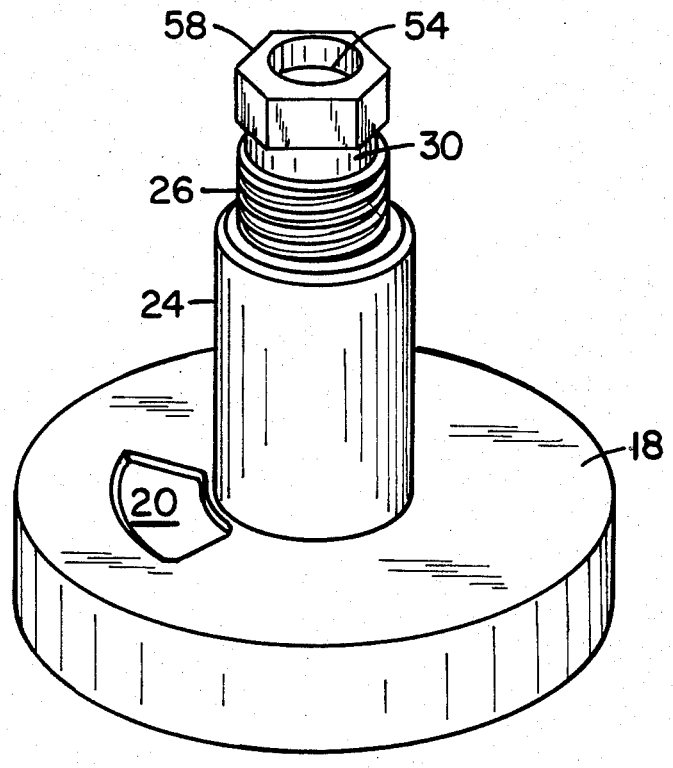
FIG. 2 is an elevational view of the stirrer closure and adjustment member.

A hollow sleeve member (30) is dimensioned and configured with corresponding threads (32) such that it can be screwed into the support (FIG. 2). A portion of the sleeve extends beyond the top of the support. The sleeve bore diameter (34) is sized so as to be able to receive the stirrer shaft (40).

The stirrer bearing is composed of an annular lower bearing surface (50) and a rotating upper bearing surface (52). Preferably, the lower surface is formed from a low friction material such as Teflon ®. It is press-fitted into a shoulder (54) formed in the top of the sleeve. The opening in the lower bearing surface (56) is large enough to receive the shaft, though it need not be the same size as that in the sleeve (30).

The upper bearing surface has a larger diameter than the lower bearing opening. It can be made of an autoclavable, low friction material such as stainless steel. In position, it downwardly engages the lower bearing surface.

The stirrer is suspended when the shaft (40) is press-fitted into an opening in the upper bearing surface. The shaft projects downwardly towards the vessel bottom through the bores of the lower bearing surface and the sleeve, into the vessel. At the bottom of the shaft is a detachable magnetic impeller (42). Although there are many conventional ways of attaching the impeller, FIG. 1 shows a slotted end (44) on the shaft into which the impeller is press fitted.

Figure 3:
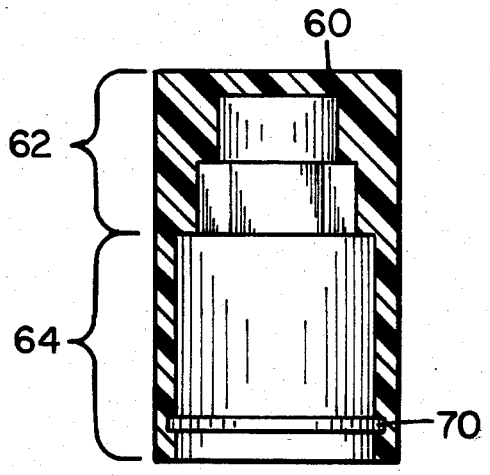
FIG. 3 is a cross-sectional view of the adjustment cap.

Finally, as shown FIGS. 1 and 3, the adjustment means comprises a cap (60) having an upper (62) and lower (64) portion. The upper portion is dimensioned and configured to engage a portion of the sleeve (36) while permitting the upper bearing to rotate. In one embodiment the top of the sleeve is in the shape of a hexagonal nut. The inside of the upper portion of the cap is cut out in a corresponding hexagonal form which fits over the nut. On the other hand, the lower portion is dimensioned and configured to slide over the exterior of the support (24). Preferably, a sealing means such as an elastic O-ring (70) is located on the inside of the lower cap portion.

When the cap (60) is placed over the support, the upper portion engages the hexagonal nut atop the sleeve, and the sealing means rests against the support exterior, sealing the vessel. More importantly, the impeller height can be adjusted simply by rotating the cap. This motion is translated into movement of the sleeve, the bearing surfaces, and thus, the stirrer.

Having described the invention with particular reference to preferred form, it will be obvious to those skilled in the art to which the invention pertain, that, after understanding the invention, various changes and modifications may be made without departing from the spirit and scope of the invention as defined by the appended claims.

I claim:

1. An improved magnetic stirring apparatus comprising: a vessel having walls, a bottom and an opening; a stirrer having a shaft and an attached magnetic impeller; a means for rotating the magnetic impeller; and a closure wherein the improvement is characterized by:

(a) a closure having an opening;

(b) a hollow adjustment support member dimensioned and configured to surround the opening in the closure:
  (i) is connected to the closure about the opening;
  (ii) upwardly projects from the closure; and
  (iii) is at least partially threaded on the interior;

(c) a hollow sleeve being dimensioned and configured:
  (i) with corresponding threads to screw into the adjustment support; and
  (ii) with an interior diameter that can receive the shaft;

(d) an annular lower bearing surface:
  (i) attached to the interior of the sleeve; and
  (ii) having an opening dimensioned and configured to receive the shaft;

(e) a rotating upper bearing surface:
  (i) having larger diameter than the opening in the lower bearing surface; and
  (ii) which downwardly engages the lower bearing surface;

(f) the shaft:
  (i) being connected to the upper bearing surface; and
  (ii) projecting downwardly, through the lower bearing surface and the sleeve, into the vessel;

(g) an adjustment means having:
  (i) an upper portion dimensioned and configured to engage a portion of the sleeve and permit the upper bearing to rotate;
  (ii) a lower portion dimensioned and configured to slide over the exterior of the support; and whereby when the means is placed over the support and engages the sleeve, the impeller height can be adjusted by turning the means.

2. The improved stirring apparatus of claim 1 wherein the sleeve extends beyond the top of the support.

3. The improved stirring apparatus of claim 1 wherein a sealing means is positioned on the interior of the lower portion of the adjustment means.

* * * * *